United States Patent [19]

Livesay

[11] 4,278,368

[45] Jul. 14, 1981

[54] APPARATUS AND METHOD FOR COMPACTING MATERIAL

[75] Inventor: Richard E. Livesay, Peoria, Ill.

[73] Assignee: Caterpillar Tractor Co., Peoria, Ill.

[21] Appl. No.: 94,255

[22] PCT Filed: Jul. 11, 1979

[86] PCT No: PCT/US79/00495

§ 371 Date: Jul. 11, 1979

§ 102 (e) Date: Jul. 11, 1979

[51] Int. Cl.[3] ..... E01C 19/38

[52] U.S. Cl. ..... 404/117; 404/121; 404/127; 37/117.5; 172/40; 172/175; 172/253

[58] Field of Search ..... 404/117, 121, 127, 133; 37/DIG. 18, 117.5; 172/40, 175, 253

[56] References Cited

U.S. PATENT DOCUMENTS

| | | | |
|---|---|---|---|
| 1,631,271 | 6/1927 | Keeler | 404/127 |
| 2,891,335 | 6/1953 | Linneman . | |
| 3,072,025 | 1/1963 | Cronin | 404/127 |
| 3,146,686 | 9/1964 | Grace | 404/127 |
| 3,183,804 | 5/1965 | LeTourneau . | |
| 3,255,682 | 6/1966 | Hedstrom . | |
| 3,302,540 | 2/1967 | Fuentes | 404/127 |
| 3,437,019 | 4/1969 | Peterson . | |
| 3,592,111 | 7/1971 | Livingston | 404/133 |
| 3,595,411 | 7/1971 | Ables | 404/121 X |
| 3,598,028 | 8/1971 | Grant | 404/121 |
| 3,635,133 | 1/1972 | Stougaard | 404/133 |
| 3,770,322 | 11/1973 | Cobb | 37/DIG. 18 |
| 3,868,145 | 2/1975 | Cobb | 172/40 X |
| 3,880,242 | 4/1975 | Rogers | 172/253 X |
| 3,891,342 | 6/1975 | Roe | 404/121 X |
| 3,909,149 | 9/1975 | Century | 404/133 |
| 3,930,741 | 1/1976 | Berry | 404/133 |
| 3,961,856 | 6/1976 | Degenhart | 404/133 |
| 4,023,288 | 5/1977 | Roe | 37/117.5 |
| 4,066,374 | 1/1978 | King | 404/117 |
| 4,098,344 | 7/1978 | Johnson | 172/175 X |
| 4,100,688 | 7/1978 | Grist | 37/117.5 |
| 4,102,403 | 7/1978 | Steinberg | 37/DIG. 18 |

*Primary Examiner*—Nile C. Byers, Jr.
*Attorney, Agent, or Firm*—Wegner, Stellman, McCord, Wiles & Wood

[57] ABSTRACT

A compacting apparatus (10) has an impact apparatus (17) and a compactor (19). The impact apparatus (17), such as, for example, a rock breaker, provides impacting forces on the compactor (19). The compacting apparatus (10) is positioned on, for example, a work structure (12,14,15) of a work vehicle (16). It is necessary to compact material in order to provide, for example, proper filling of a trench (74) after a pipe has been placed in the trench. Compaction, as done by the compacting apparatus (10), is provided by simultaneously compacting the material and applying a compressive force to the material and remolding the material. Therefore, satisfactory compaction can be provided in the trench (74) by the work vehicle (16) which is also usable to excavate and refill the trench (74).

15 Claims, 3 Drawing Figures

APPARATUS AND METHOD FOR COMPACTING MATERIAL

DESCRIPTION

1. Technical Field

This invention relates to a compactor and a method of compaction and, more particularly, to an impact apparatus and a roller compactor for use in pressure, impact and remolding compaction.

2. Background Art

Earth compaction equipment is usually very large, is self-propelled over the earth being compacted, or is pulled by tractors, or the like. One such piece of equipment is shown in the Le Tourneau U.S. Pat. No. 3,183,804, issued May 18, 1965. This type of apparatus provides pressure compacting only. That is, all of the power and weight of the self-propelled compacting machine is used for compacting. A similar piece of equipment is shown by Giertz-Hedstrom U.S. Pat. No. 3,255,682, issued June 14, 1966, which shows a compacting apparatus drawn by a tractor, or the like, wherein the weight of the apparatus and an eccentric fixed on the axle of the compactor creates a vibratory affect which adds vibratory compaction to the pressure compaction.

The Peterson U.S. Pat. No. 3,437,019, issued Apr. 8, 1969, shows a roller-type compactor which has vibrators which rotate with a drum for creating a vibratory affect for the compactor. The Degenhart U.S. Pat. No. 3,961,856, issed June 8, 1976, shows an apparatus that compacts the earth by a vertical hammering affect as the plate-type compacting plate is moved along the surface of the ground. Another form of hydraulic compactor is provided by the Century U.S. Pat. No. 3,909,149, issued Sept. 30, 1975, where a vibratory plate-type compactor is carried at the outer end of the boom of an excavator, or the like, which compactor is vibrated against the earth for compacting same. The King U.S. Pat. No. 4,066,374, issued Jan. 3, 1978, shows a vibratory sheepsfoot mounted on a tractor which provides vibration to a compacting cylinder as it is drawn through a trench to compact the soil in the trench.

The Linneman U.S. Pat. No. 2,891,335, issued June 23, 1959, and the Grist U.S. Pat. No. 4,100,688, issued July 18, 1978, both show roller-compacting-members mounted, in the case of the U.S. Pat. No. 2,891,335 patent, on a grader and, in the case of the U.S. Pat. No. 4,100,688 patent, on the boom of an excavator so that as the earth grader is moved or as the boom of the excavator is moved, the roller compactor compacts the soil in the trench or the like.

All of the above prior art fail to provide a compactor which provided improved compaction using the three types of compaction techniques, namely pressure compaction, impact compaction and remolding compaction.

DISCLOSURE OF INVENTION

The present invention is directed to overcoming one or more of the problems of the prior art and to provide an improved flywheel energy wheel compactor.

In one aspect of the present invention, a compacting apparatus has an impact apparatus and a compactor having a roller portion and yoke supported by the roller portion. Means removably connects said compactor at the yoke to the impact apparatus and delivers impacting forces from a shank of said impact apparatus to the compactor.

In another aspect of the present invention, a work vehicle has a work structure, an impact apparatus supported by said work vehicle and a compactor. Means removably connect the compactor to the work structure and delivers impacting forces from the shank to the compactor. The work structure is of a construction sufficient for controllably, simultaneously applying a compressive force through the compactor on material to be worked and moving said compactor along said material to be worked when said impacting forces are delivered to said compactor.

In still another aspect of the present invention, a method for compacting material includes simultaneously impacting said material and controllably applying a steady compressive force on said material and remolding said material with said compactor.

For example, compacting apparatus are often used to compact fill placed in a trench following excavators and laying of pipe in the trench. Such trenches are dug commonly by excavators. The compacting apparatus of the present invention can be connected to the excavator to conveniently provide excavation and compaction functions on the one work vehicle. The compacting apparatus provides impact, pressure and remolding types of compaction for efficient working of the material in the trench.

BEST MODE FOR CARRYING OUT THE INVENTION

Figure 1:
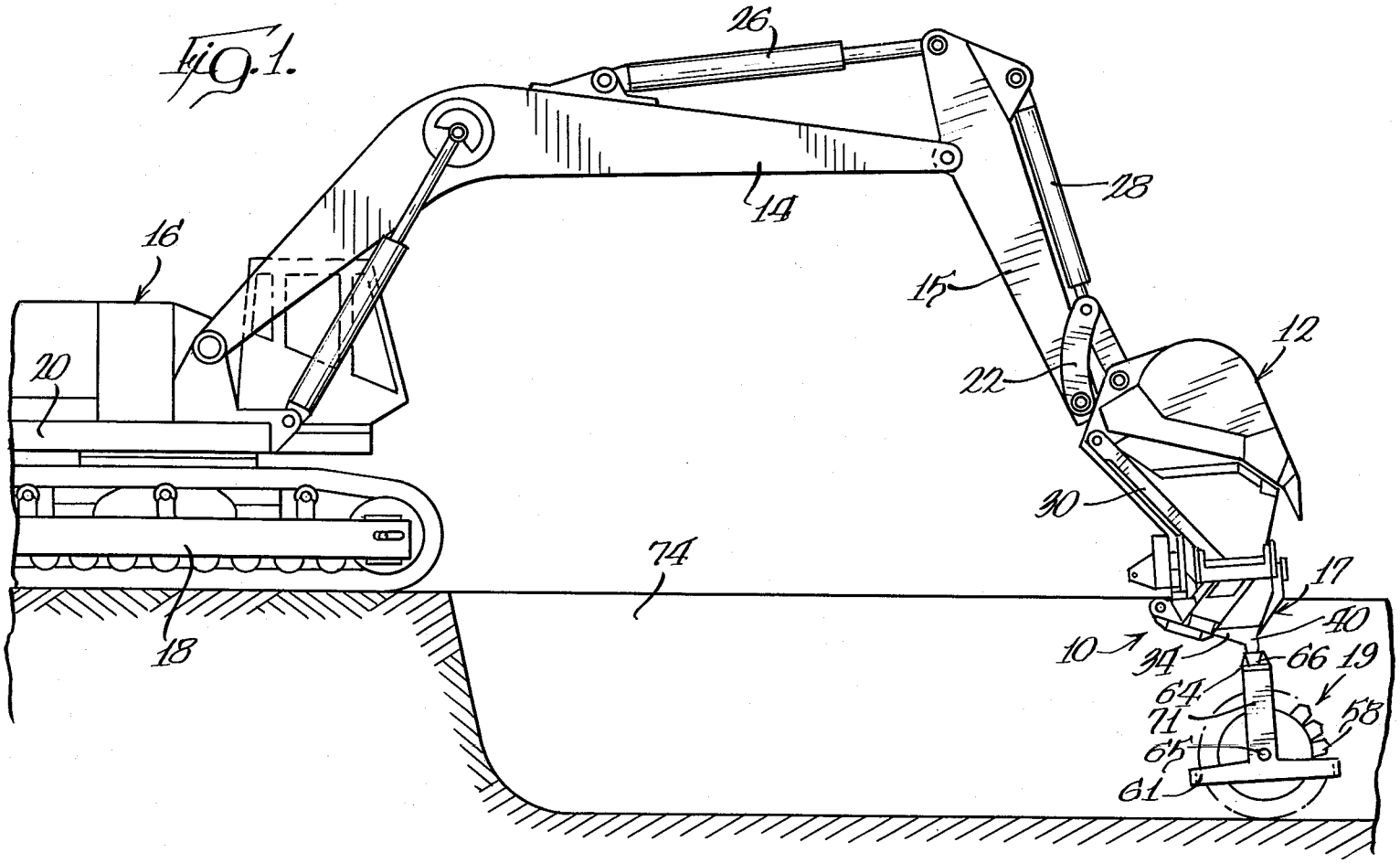
FIG. 1 is a side elevational view of an embodiment of a compactor apparatus mounted on the stick of a hydraulic excavator.

Referring to the drawings and, in particular, to FIG. 1, there is illustrated a compacting apparatus 10 in accordance with the present invention shown carried, for example, on an end portion of a bucket 12 at the outer end of work structures of a work vehicle, such as the boom 14 and stick 15 of a hydraulic excavator 16. The compacting apparatus 10 is comprised of an impact apparatus 17 and a compactor 19. The hydraulic excavator 16 is a conventional-type excavator comprising an undercarriage 18 and a rotatable upper structure 20 that is rotatable about a vertical axis through the undercarriage 18. The upper structure 20 has connected thereto the usual bucket linkage assembly generally comprising the boom 14, the stick 15, and a bucket tilt linkage 22 at the outer end of the stick 15. The linkage 22 is manipulated in a known manner by suitable hydraulically-powered jacks or motors 24, 26 and 28, respectively. The bucket 12 is controllably positionable relative to material to be worked, as is known in the excavation art.

A mounting rig 30 is provided for connection to the bucket 12 when the bucket is tilted to its most inverted position with the jack 28 retracted and with the cavity of the bucket facing downwardly therefrom. The mounting rig 30 is secured to the bucket 12 and to the bucket linkage 22 so as to be able to move the boom 14, stick 15 and bucket 12. The mounting rig 30 can be readily removed from or attached to the bucket 12 without requiring special tools, hydraulic lift equipment, and the like.

Figure 2:
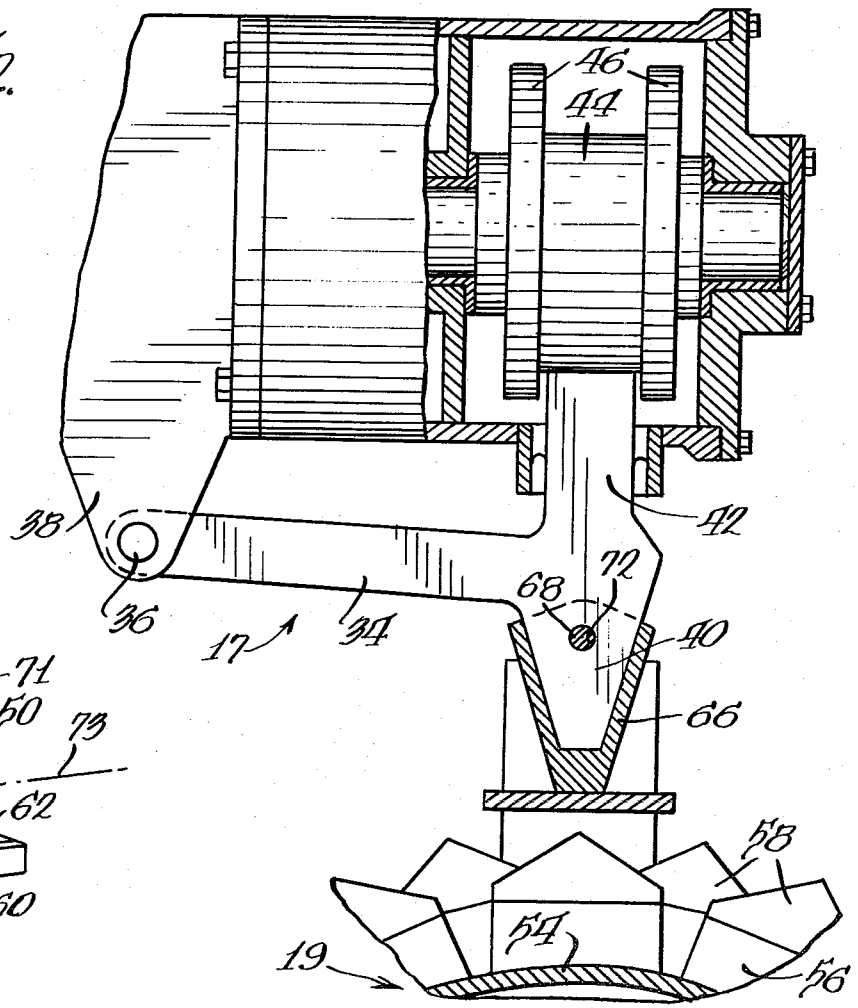
FIG. 2 is an enlarged, partially broken away view of an impact apparatus and its connection to the yoke of a roller wheel compactor; and, FIG. 3 is a perspective view of an embodiment of a roller wheel compactor mounted in a support yoke or frame and showing the connection to the impacting tip of the impact apparatus.

The mounting rig 30 supports the impact apparatus 17 at the lower end thereof. The impact apparatus 17 can be an adoption of, for example, a rock breaker. One such rock breaker adopted as an impact apparatus 17 is shown and described in U.S. Pat. No. 3,868,145 in the name of Cobb et al, issued Feb. 25, 1975, and is incorporated herein by reference for a detailed discussion of the structure and operation of the impact apparatus 17. Briefly stated, the impact apparatus 17, as shown in FIG. 2, is mounted horizontally on the end of the mounting rig 30 and has a shank 34 pivotally secured at 36 to the housing 38. The shank 34 has an impacting adapter 40 projecting away from the housing 38 and has an impact-receiving portion 42 extending into the housing 38 in alignment with the impacting adapter 40. An impacting member 44 is eccentrically mounted in the housing 38 between flywheels 46, such that when a hydraulic motor in the housing 38 is activated, the eccentrically-mounted impacting member 44 will administer impacting forces to the impact-receiving portion 42 and impacting adapter 40 of the shank 34.

Figure 3:
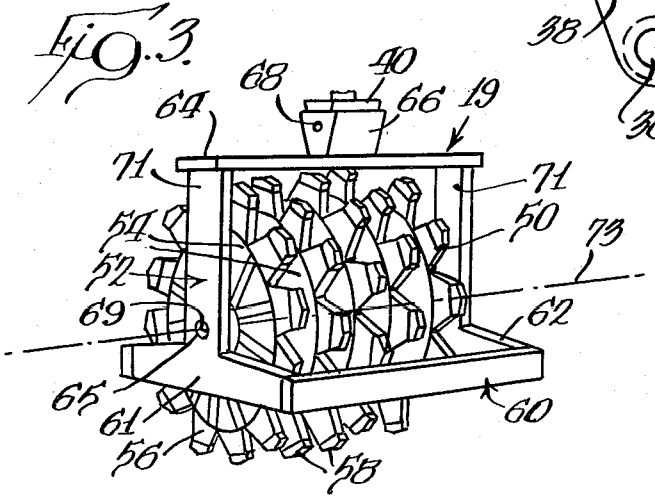

The compactor 19, as shown in FIGS. 1, 2 and 3, is comprised of a roller portion 50 and a yoke 52 for supporting the roller portion 50. The roller portion 50 includes a plurality of juxtaposed circular discs 54, with each disc having a plurality of radially extending feet 56 with hardened tips 58 thereon. The feet 56 of each disc 54 are spaced axially and circumferentially from the feet 56 of the adjacent disc 54 so as to present a cylindrical member having randomly projecting compacting points or tips 58 projecting from the outer surface thereof. The yoke 52 encompasses the roller portion 50 and is preferably comprised of a rectangularly-shaped frame 60 surrounding the roller portion 50 with the two ends 61,62 of the frame lying parallel to the opposite end discs of the roller portion 50 and with a bridge 64 extending upwardly from the ends 61,62 of the frame 60 and spans across the width of the roller portion 50. The roller portion 50 has an axle 65 extending from the ends thereof into bearings 67 mounted in openings 69 in the vertical legs 71 of the bridge 64. Means, shown as a socket 66, is provided for removably connecting the compactor 19 in a preselected relationship relative to the impact apparatus 17 and delivering impacting forces from the shank 34 to the compactor 19. The compactor 19 is shown connected at the yoke 52 to said impact apparatus which is positioned on or supported by the bucket 12 of the excavator 16. The socket 66 is welded or otherwise secured to the midportion of the bridge 64 for receiving the impacting adapter 40 of the impact apparatus 17. A pin 68 passes through aligned apertures 70 in the ends of the socket 66 and through an aperture 72 in the impacting adapter 40 for connecting the compactor 19 to the impact apparatus 17. Appropriate hydraulic lines extend from the cab of the excavator 16 to the hydraulic motor in the impact apparatus 17 so that the impact apparatus can be driven to apply positive impacting forces to the impacting adapter 40 and to the compactor 19. The roller portion 50 of the compactor 19 has an axis of rotation 73 and is rotatably connected to the yoke 52 along said axis of rotation 73. The impacting forces are delivered to the compactor 19 through and substantially perpendicular to the axis of rotation 73.

Industrial Applicability

A preferred use of the apparatus is for pressure, impact and remolding compaction of a trench. A trench 74 is opened and cleaned, after which the appropriate pipe is laid in the bottom thereof. Back fill is added to the trench 74 over the pipe whereupon the compacting apparatus 10 is lowered into the trench 74 and the impact apparatus 17 is activated to apply impacting forces through the impacting adapter 40 and to the compactor 19. Compressive force or downward pressure is applied through the boom 14 and stick 15 of the excavator 16 to add to the weight of the boom 14, stick 15, bucket 12, impact apparatus 17 and compactor 19. The excavator 16 also simultaneously moves the compactor 19 along the bottom of the trench 74 to compact the soil added to the trench. The soil is compacted under pressure and under the impacting forces of the impact apparatus 17 as the trench 74 is remolded according to the shape of the compactor 19.

Thus, the method for compacting the fill material includes the steps of controllably positioning the compactor 19 at a preselected position relative to said material and simultaneously compacting said material and controllably applying a steady compressive force on said material and remolding said material with soil compactor 19. The compactor 19 is moved across and in contact with the material while simultaneously impacting on, applying compressive force to, and remolding the material in order to completely compact the fill material in the trench.

Other aspects, objects and advantages of this invention can be obtained from a study of the drawings, the disclosure and the appended claims.

I claim:

1. A compacting apparatus (10) carried by a vehicle, comprising:
   - an impact apparatus (17) having a shank (34), said impact apparatus (17) providing impacting forces on said shank (34);
   - a compactor (19) having a yoke (52) and a roller portion (50), said yoke (52) supporting said roller portion (50); and
   - means for removably connecting said compactor (19) at the yoke (52) to said shank (34) on said impact apparatus (17) and delivering said impacting forces from the impact apparatus (17) to said shank (34) and then to the compactor (19).

2. The compacting apparatus (10), as set forth in claim 1, wherein said roller portion (50) of the compactor (19) is of a construction sufficient for remolding material to be compacted in response to moving said compactor (19) across and in contact with said material.

3. The compacting apparatus (10), as set forth in claim 1, wherein the impacting forces are delivered to and externally on the compactor (19) through said yoke (52).

4. The compacting apparatus (10), as set forth in claim 1, including means for providing compressive force through said compactor (19) on material to be worked when said impacting forces are delivered to the compactor (19).

5. The compacting apparatus (10), as set forth in claim 3, wherein said roller portion (50) has an axis of rotation (73) and is rotatably connected to said yoke (52) along said axis of rotation (73) and said impacting forces are delivered to the compactor (19) through and substantially perpendicular to said axis of rotation (73).

6. The compacting apparatus (10), as set forth in claim 3, wherein said yoke (52) comprises a frame (60) and a bridge (64) connected to said frame (60) and said roller portion (50) is rotatably connected to said yoke (52).

7. The compacting apparatus (10), as set forth in claim 1, wherein the means includes a socket (66) mounted on said compactor (19) and said shank (34) of the impact apparatus (17) is connectable to said socket (66).

8. In a compacting apparatus for a work vehicle (16) having a boom (14), a stick (15) and a bucket (12), an impact apparatus (17) carried by said bucket (12), a shank (34) pivotally mounted on said apparatus, an impacting adapter (40) on said shank (34) extending away from said apparatus (17), an impact-receiving portion (42) on said shank (34), and means (44) on said apparatus (17) for intermittently engaging said impact-receiving portion (42), the improvement comprising:

a roller compactor (19) having a yoke (52) supporting a roller portion (50) which has means (56) engaging the earth;

a socket (66) on said yoke (52);

said impacting adapter (40) of the impact apparatus (17) engaging said socket (66) on said roller compactor (19); and said intermittently engaging means (44) driving said impact-receiving portion (42) and said shank (34) for providing intermittent impacting forces to the compactor (19) and to the roller portion (50).

9. The compacting apparatus, as set forth in claim 8, including a mounting rig (30) attached to said bucket (12) and to said impact apparatus (17) to support said impact apparatus (17) on said vehicle.

10. The compacting apparatus, as set forth in claim 8, wherein said yoke (52) comprises a frame (60) and a bridge (64) connected to said frame (60), and said roller portion (50) is rotatably mounted to said yoke (52).

11. The compacting apparatus, as set forth in claim 11, wherein said socket (66) is mounted on said bridge (64) and said impacting adapter (40) of the impact apparatus (17) is fastened to said socket (66).

12. In a work vehicle (16) having a work structure having an end portion (12) controllably positionable relative to material to be worked, the improvement comprising:

an impact apparatus (17) having a shank (34) and being supported by said work vehicle and being of a construction sufficient for providing impacting forces on said shank;

a compactor (19);

means for removably connecting said compactor (19) to said end portion of the work structure and delivering said impacting forces from the shank (34) to said compactor (19); and said end portion (12) of the work structure (12,14,15) being of a construction sufficient for controllably, simultaneously applying a compressive force through said compactor (19) on the material to be worked and moving said compactor (19) along said material to be worked when said impacting forces are delivered to said compactor (19).

13. A method for compacting material, comprising:

controllably positioning a rolling compactor (19) at a preselected position relative to said material; and simultaneously impacting said rolling compactor as said compactor is rolled over the material to impact said material and to controllably apply a steady compressive force on said material for remolding said material with said compactor (19).

14. The method, as set forth in claim 13, wherein said rolling compactor (19) is rolled across and in contact with said material while simultaneously impacting on, applying the compressive force to, and remolding said material with said compactor (19).

15. The method, as set forth in claim 13, wherein said rolling compactor (19) has a plurality of compacting feet (56) of a construction sufficient for remolding said material.

* * * * *